US006387149B1

(12) United States Patent
Harada et al.

(10) Patent No.: US 6,387,149 B1
(45) Date of Patent: May 14, 2002

(54) METAL POROUS BODIES, METHOD FOR PREPARATION THEREOF AND METALLIC COMPOSITE MATERIALS USING THE SAME

(75) Inventors: Keizo Harada, Itami; Kenichi Watanabe, Takarazuka, both of (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 09/604,009

(22) Filed: Jun. 26, 2000

(30) Foreign Application Priority Data

Jun. 29, 1999 (JP) ..... 11-183534
Dec. 8, 1999 (JP) ..... 11-348794
May 12, 2000 (JP) ..... 2000-140037

(51) Int. Cl.[7] ..... B22F 3/10
(52) U.S. Cl. ..... 75/239; 75/240; 419/2; 419/14; 419/15
(58) Field of Search ..... 419/2, 14, 15; 75/239, 240

(56) References Cited

U.S. PATENT DOCUMENTS 5,597,665 A * 1/1997 Harada et al. ..... 429/235
5,640,669 A * 6/1997 Harada et al. ..... 428/552

FOREIGN PATENT DOCUMENTS

DE 19810544 A1 9/1998
EP 0732417 A1 9/1996
EP 0769821 A2 4/1997
JP 38-17554 9/1938
JP 57-174484 10/1982
JP 6-89376 11/1994
JP 9-122887 5/1997
JP 9-231983 9/1997
JP 10046268 A 2/1998
JP 10-251710 9/1998

OTHER PUBLICATIONS

European Search Report dated Aug. 20, 2000.

* cited by examiner

*Primary Examiner*—Daniel J. Jenkins
(74) *Attorney, Agent, or Firm*—McDermott, Will & Emery

(57) ABSTRACT

A metal porous body having a skeleton which has a foam structure, composed of an alloy composed mainly of Fe and Cr and includes a Cr carbide and/or FeCr carbide uniformly dispersed therein. The metal porous bodies are obtained by preparing a slurry mainly composed of an Fe oxide powder of average particle not more than 5 $\mu$m, at least one powder selected from among metallic Cr, Cr alloy and Cr oxide powders, thermosetting resin and a diluent; applying this slurry onto a foamed resin core body; then drying, and then forming a metal porous body by firing in a non-oxidizing atmosphere, including a heat-treatment at 950 to 1350° C. The metal porous bodies thus obtained have excellent heat resistance, corrosion resistance and strength and are useful as electrode base plates, catalyst supports and filter materials, and furthermore, as metallic composite materials.

11 Claims, 2 Drawing Sheets

METAL POROUS BODIES, METHOD FOR PREPARATION THEREOF AND METALLIC COMPOSITE MATERIALS USING THE SAME

BACKGROUND OF THE INVENTION

1. Field of the Invention

The present invention relates to metal porous bodies comprising an alloy having high strength, excellent corrosion resistance and heat resistance, which have applications in electrode substrates, catalyst supports, filters, metallic composite materials and the like, and also relates to a method of preparing such metal porous bodies.

2. Description of the Related Art

Conventionally, metal porous bodies have been used in various applications such as filters and battery plates where heat resistance is required, and catalyst supports and metallic composite materials. Hence, techniques for the preparation of metal porous bodies have come to be known through a variety of documents. Furthermore, products in which an Ni-based metal porous body commercially available as "CELMET" (registered trade name) prepared by Sumitomo Electric Ind., Ltd. are already being widely used in industry.

As conventionally known methods for the preparation of metal porous bodies, there are the plating method which is performed after treating a foamed resin or the like to render the same to be electrically conductive as disclosed in Japanese Patent Application Laid-Open No. 57-174484, and the method in which metal powder is formed into a slurry, the slurry is applied to a foamed resin or the like, and sintered, as disclosed in Japanese Patent Publication No. S38-17554.

The plating method involves attachment of an electrically conductive material, vapor deposition of an electrically conductive material, or surface modification with a chemical agent, as a treatment for rendering the surface of a foamed resin or the like electrically conductive. A metal porous body is obtained by metal plating the foamed resin or the like which has been rendered electrically conductive, and then burning out and removing the resin part therefrom. Electroplating and electroless plating, for example, can be used in the formation of the metal skeleton. However, since the both methods involve plating, a metal porous body thus obtained consists of a single metal in either case. Known alloying treatments include a method in which, after the plating with different types of metal, these metals are diffused in a later step, and a method in which, after the plating with a single metal, diffusion alloying treatment is performed.

In the sintering method, a slurry comprising metal powder and resin is coated or sprayed onto a foamed resin or the like, and then subjected to a sintering treatment after drying. With the method disclosed in the aforementioned Japanese Patent Publication No. 38-17554, alloying treatment can be performed if several types of metal materials are used.

However, although it is possible to obtain alloyed metal porous bodies, they are inferior in strength to the metal porous bodies obtained by a combination of plating and diffusion alloying treatments. This problem is related due to adhesion among the metal powders obtained by sintering.

As a means of improvement in this respect, Japanese Patent Publication No. 6-89376 discloses a method for improving the adhesion in which the surface of iron powder is oxidized while controlling the carbon content in the iron powder, so that the surface of iron is reduced during sintering as a result of an oxidation-reduction reaction between the carbon contained in the iron and the oxygen in the oxide formed on the iron surface. With this method, however, the metal parts within the iron particles take no part in the reaction. Therefore, although it provides an improvement at the boundary faces in the resultant skeleton structure, the inadequacy of the mechanical strength in the original metal structure still remains.

Furthermore, Japanese Patent Application Laid Open No. 9-231983 discloses fine-grained metal sintered porous bodies which are produced from iron oxide powder as a raw material. Since metal porous bodies consisting of iron alone are inadequate in terms of strength, corrosion resistance and heat resistance, these properties are improved by alloying in this disclosure. However, the alloying of the aforementioned invention is not realized simply by adding powder or an oxide of a metal other than iron.

Moreover, there is a trend that metal porous bodies are used more and more for preparing a metallic composite material. This technique is widely used as a means of reducing weight in which Al alloys are formed into casting, as referred to Al die-casting. However, in view of the properties of Al itself, the heat resistance etc. is inadequate, and attention is being focused on improvement of the properties of Al by alloying and methods of use for the preparation of metallic composite materials. Similarly, there is a possibility of use for reinforcing the mechanical strength of Mg alloys.

A technique for the preparation of metallic composite materials using metal porous bodies is disclosed in detail in Japanese Patent Application Laid Open No. 9-122887. According to the disclosure in this publication, composited light metal alloys can be used in particular in parts which are subject to use under severe conditions, such as sliding parts for example. Consequently, the metal porous bodies used for the preparation of such composite materials must have properties which satisfy the requirements in the application in which they are to be used.

The aforementioned "CELMET" is already being used as a metal porous body for the preparation of metallic composite materials, and a technique which is intended to bring about an especially advantageous effect in properties has been disclosed in Japanese Patent Application Laid Open No. 10-251710. According to the description, the metal porous body is obtained by applying a slurry which contains metal powder and ceramic powder onto a foamed material capable of burning out, then burning out the resin part in a reducing atmosphere where steam and/or carbon dioxide is contained in a reducing gas; and then firing the metal body in a reducing atmosphere. As a result, the ceramic particles are dispersed within a skeleton of the resultant metal porous body and a metal porous body with the properties of ceramic is obtained.

As described above, the techniques of filling the skeletons of metal porous bodies with molten metal for producing metallic composite materials have been progressed day by day for the improvement of the properties of the metallic composite materials.

As for the techniques of metallic composite materials, studies have been made on various techniques for the preparation of composite materials from Al or Mg metal and further for the preparation of composite materials from Al alloys and Mg alloys, and problems which are encountered when using metallic composite materials have been resolved by these studies. Metallic composite alloys are gaining attention and being used as materials for automobile engine parts, for example. However, the requirements for engine materials have become even more severe for the purpose of the improvements which are being made in view of the automobile exhaust gas regulations etc., and further improvement of their properties is now required. For the parts used in wear resistant piston rings in diesel engines in particular, much improved wear resistance is required to the composite materials to be used. There is also a means of compositing by using the metal porous bodies containing ceramic particles, as disclosed in the aforementioned publication, but, when such means is used, the pre-forming process of the ceramic containing metal porous body is difficult and this imposes a limitation on shape.

SUMMARY OF THE INVENTION

The present invention has been realized as a result of investigations based upon the demands for such technical improvements, and it provides a material having performance which meets these demands. Specifically, the present invention provides a metal porous body with a foam structure, a skeleton of which is composed of an alloy containing Fe and Cr, and in which a Cr carbide and/or FeCr carbide is uniformly dispersed. The amount of metal carbide contained can be determined from a carbon content, and a carbon content of at least 0.1% but not more than 3.5% in the skeleton of a metal porous body brings about especially desirable properties. The metal porous body principally consists of,Fe and Cr and a Cr carbide and/or FeCr carbide is uniformly dispersed in the composition, which provides the metal porous body with a strength that has never been realized before. It is especially desirable that the carbon content calculated from the amount of carbides be within the range indicated above. If the carbon content is less than 0.1%, then the amount carbide in the skeleton is small and so the wear resistance is poor, and if the carbon content exceeds 3.5% then the skeleton itself becomes hard and difficulties may arise when working a prefoam, as referred to in the same way as previous techniques in which ceramic particles were used. Further, the metal porous body having an excess or insufficient carbon content causes problems such that the metallic composite material prepared from such a metal porous body has poor workability or causes wear of the counterpart when used in a sliding part or device. A carbon content of 0.3 to 2.5% will provide further improved properties.

In the aforementioned preferred carbon content range, the Vicker's hardness of the skeleton of the metal porous body is within the range from 140 to 350, which brings about a good effect in particular in the workability and wear resistance after being formed into a composite material.

In the present invention, the metal skeleton preferably contains at least element selected from the group consisting of Ni, Cu, Mo, Al, P, B, Si and Ti, so that toughness is increased even more.

The method for preparing a metal porous body in accordance with the present invention is as follows.

A slurry composed mainly of an Fe oxide powder of average particle size not more than 5 $\mu$m, at least one powder selected from the group consisting of metallic Cr, Cr alloy and Cr oxide powders, a thermosetting resin and a diluent is prepared, this slurry is applied onto a foamed (porous) resin core and then dried. In the subsequent firing process in a non-oxidizing atmosphere including a heat-treatment at a temperature of 950 to 1350° C., a sintered body which has a skeleton composed mainly of the aforementioned Fe and Cr and having a Cr carbide and/or Cr carbide uniformly dispersed is obtained. When this is done, the metal carbide is in a uniformly dispersed state, unlike that in the case where metal carbide is added from the beginning as a carbon component. Further, the metal carbide phase resulting from the process of the present invention has a mean grain size in the range of 2 $\mu$m to 5 $\mu$m and brings about a good effect in properties such as wear resistance of the resultant metal porous body.

The aforementioned additional metals are included in the skeleton of the alloyed metal porous body after sintering by mixing the metal powder in the slurry.

A preferred embodiment of the aforementioned firing process is characterized by including a first heat-treatment step in which the resin component of the porous resin core on which the slurry has been coated and dried is carbonized in a non-oxidizing atmosphere, and a second heat-treatment step at a temperature from 950° C. to 1350° C. in a reducing atmosphere in which part of the metal component (the Fe oxide and at least one of Cr, its oxide or alloy) is converted to carbide while the metal oxide is reduced by the carbonized component which has been produced in the first heat-treatment, and then the reduced metal fraction is alloyed and sintered.

In this embodiment, by using Fe, which forms the base of the metal porous body, as finer particles and adding the first heat-treatment step prior to sintering, a metal porous body of an Fe and Cr alloy can be obtained with high strength, heat resistance and corrosion resistance. By production using this method in particular, the resultant metal porous body has a metal density which is increased in the cross section of the metal porous body skeleton and an open pore area ratio of not greater than 30%.

The key factors to be especially noted in the preparation process are the mixing proportion the resin component, which provides the carbon source for forming the carbides, and the firing conditions.

It is preferable that the ratio of the carbonized component, which has been produced in the heat-treatment step from the porous resin porous body and the resin component used in the slurry, and the Fe oxide and other oxide powder which is added to the slurry, be preferably within a certain range, and the formulation of the slurry is best determined on the basis of this relationship. The best method of determining this ratio is that, in the mixing ratio of the resin component, such as the thermosetting resin, to be mixed to be added in the slurry and the oxide powders, the rate of th e carbon residue of the whole resin component, including the resin porous body which may remain in the skeleton of the porous body formed by the heat-treatment step, and the ratio by weight of the whole resin component to the oxide should be within the range which satisfies equation (1) below.

$$11<X\times Y<38 \quad (1)$$

where:

X=rate (wt %) of the carbon residue of the resin component; and

Y=ratio by weight of the resin component with respect to the oxide.

The above rate "X" of carbon residue of the resin component is the total rate of the carbon residue of the whole resin component, mainly the thermosetting resin added to the slurry and the resin porous body constituting the initial skeleton. The rate of the carbon residue is determined using the method described in JIS K2270. Specifically, a slurry is prepared from the thermosetting resin, dispersing agent, solvent, diluent, etc. (excluding the metal component, such as metal oxide, metal, etc.), applied onto a resin porous body and dried. The whole weight of the thus dried resin component (i.e., the total weight of the resin porous body, thermosetting resin, dispersing agent, etc.) is measured and indicated as W2. Then, the resin porous body on which the thermosetting resin, etc. have been applied is heated and carbonized as specified in JIS K2270 and the resultant weight W3 is measured. The rate "X" (wt %) of the carbon residue of the resin component is obtained from the equation W3/W2×100.

"Y" is calculated from the equation W2/W4 wherein W2 is the weight of the dried resin component as specified above and W4 is the weight of the metal oxide in the metal component (metal oxide, metal, etc.) to be added to the slurry. The metal oxide is mainly Fe oxide, but, when Cr oxide has been used, this component is included. Under such mixing conditions, the reduction of the oxide proceeds with a good balance in the second step and metal porous bodies which have superior strength can be obtained.

In cases where it is desirable that the carbon content in the metal porous body obtained is between 0.1% and 3.5%, the mixing ratio of the oxide powder and the thermosetting resin is preferably so controlled as to satisfy the following equation (2):

$$5.1<a\times b<11 \quad (2)$$

wherein "a" is the rate (wt %) of the carbon residue of the thermosetting resin to be added in the form of solution to the slurry and "b" is the ratio by weight of the thermosetting resin added in the form of solution to the slurry with respect to the metal oxide. This rate of the carbon residue is calculated fromt eh following equation:

$$a(\text{wt }\%)=c{:}\mathbf{3}/c\mathbf{2}\times 100 \text{ and } b=c\mathbf{2}/c\mathbf{4},$$

wherein c2 is the weight of the thermosetting resin solution to be added to the slurry, c3 is the weight remaining after heating and carbonizing the thermosetting resin solution, as specified in JIS K2270 and c:4 is the weight of the metal oxide and is the same as the above W4.

Throughout the specification, X and Y in equation (1) and a and b in equation (2) are calculated as described above.

The sintering conditions of the production process of the present invention are also influenced by the carbon source which is contained in the slurry and the amount of oxygen in the metal oxides. Some change must be made to the conditions according to the compounded amounts.

Since the metal porous body formed in this way has a uniformly dispersed metal carbide phase and a metal phase and the metal carbide phase is composed of carbide in every part thereof including the interior part, it has high toughness and superior wear resistance.

The metal porous bodies are suitable for the preparation of metallic composite materials by pouring in an Al alloy or Mg alloy melt. The preferred metallic composite materials are formed, in particular, with the pouring in of an Al alloy or Mg alloy melt under a pressure of at least 98 kPa wherein the Al alloy or Mg alloy matrix conforms with the metal porous body upon compositing.

Moreover, it is possible to obtain alloys suited for the intended use by adding a third material other than alloys of Fe and Cr. That is to say, addition of a third powder or its oxide powder will produce an effect of enhancing the heat resistance, corrosion resistance, wear resistance, mechanical strength, etc. Ni, Cu, Mo, Al, P, B, Si, and Ti are typical examples of such a third material. These third materials may be added as metal powder or oxide powder. Since some materials can be easily obtained as powders when they are in the state of oxide even if they are difficult to form into powders when they are in a state other than oxide. The invention is very useful in such cases as well.

In those cases where the aforementioned third material is added as an oxide, this oxide of the third material is also taken into consideration in "Y" and "b" in the earlier relationship equations (1) and (2), respectively.

DESCRIPTION OF THE PREFERRED EMBODIMENTS

Figure 1:
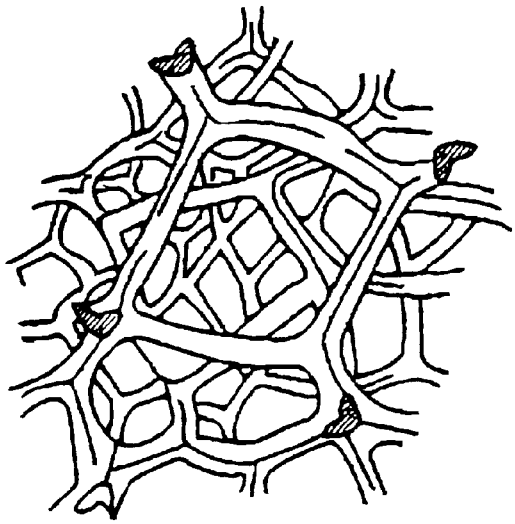
FIG. 1 is an enlarged schematic view of a metal porous body which has been prepared in accordance with the present invention.
Figure 2:
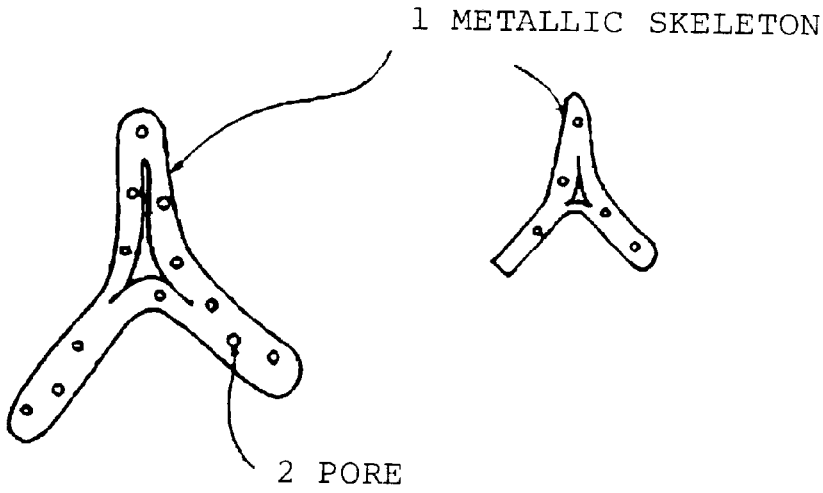
FIG. 2 is an explanatory drawing which shows the cross section of the metal porous body skeleton.

FIG. 1 is an enlarged schematic view of a metal porous body of the present invention. In external appearance it is similar to a resin porous body, but since the slurry is applied onto the skeleton of the resin porous body, dried and then sintered, the interior of the metallic skeleton 1 has pores 2, and the cross section of the skeleton becomes as shown in FIG. 2 as a result of shrinkage during carbonization and sintering.

Figure 3:
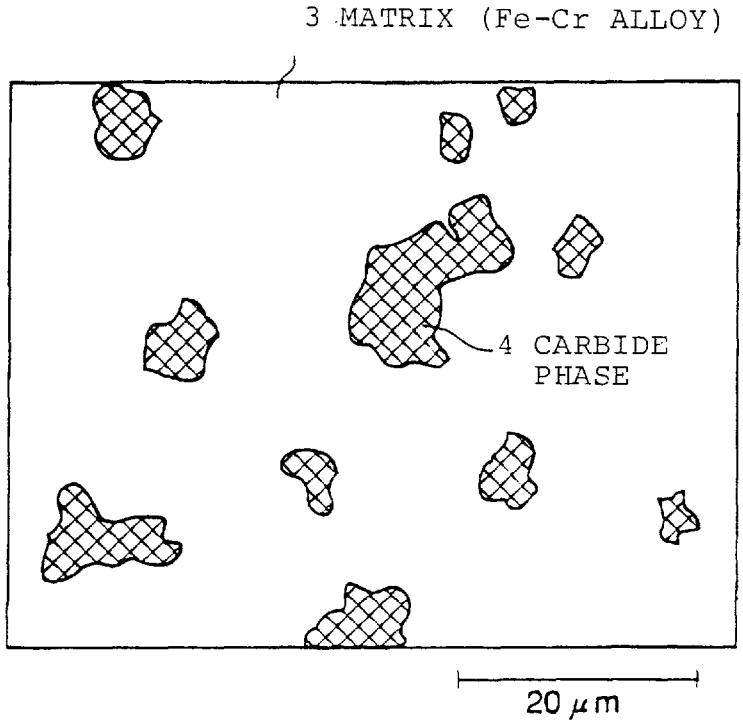
FIG. 3 is a drawing which shows the presence of the metal carbide which is dispersed in the cross section of the skeleton of a metal porous body of the present invention.

FIG. 3 constitutes the cross section of the skeleton of a metal porous body of the present invention, which shows a state in which a metal carbide phase 4 is dispersed in an alloy phase matrix 3 comprising Fe and Cr. Pores may be present in the skeleton, as shown in FIG. 2, but these pores have been omitted from this drawing. In those cases where the metal carbide is added in the form of carbide powder or the like from the beginning, the carbide phase 4 are not present in the alloy phase matrix 3 in an adequately dispersed state because the particles of the carbide phase are per se too large. However, in this invention, since the metal carbide phase 4 is finely and uniformly dispersed throughout the alloy phase matrix 3, it conforms well with the alloy phase matrix 3 and provides superior toughness to the resultant metal porous body.

Figure 4:
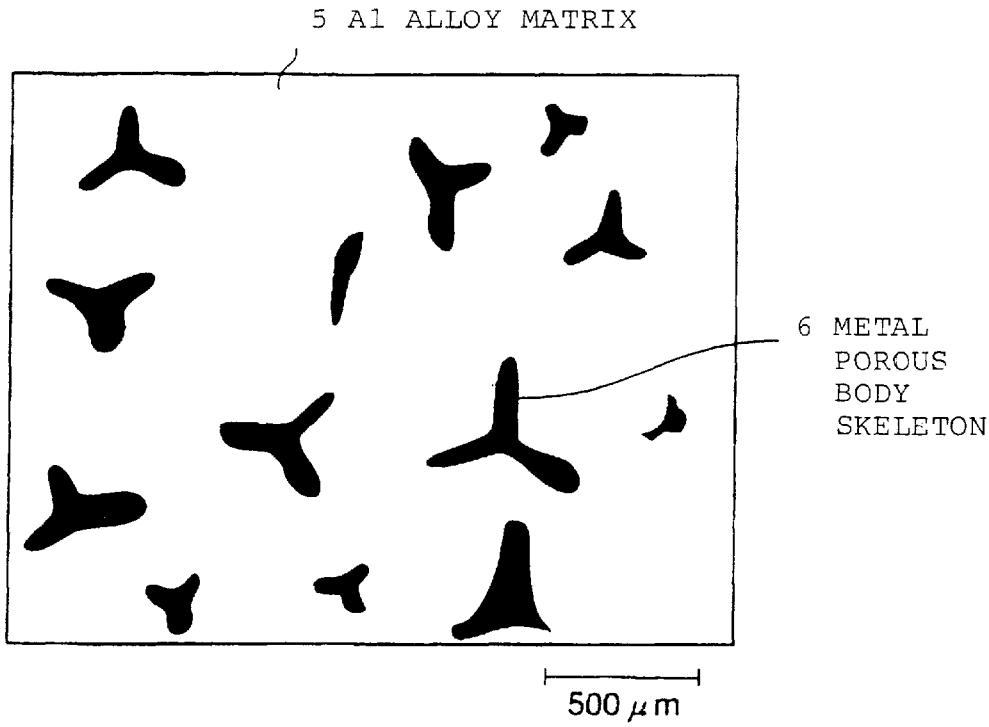
FIG. 4 is an enlarged cross section of a metallic composite material in which a metal porous body of this invention is used.

The cross section of a metallic composite material obtained by compositing the metal porous body of this invention with an Al alloy is shown in FIG. 4. The internal composition of the metal porous body skeleton 6 cannot be observed due to reflected light, but no gaps or the like can be seen at the boundary with the Al alloy matrix 5 and a state of satisfactory compatibility has been established. The properties as a metallic composite material are enhanced as a result of this state and the metallic composite material has both excellent wear resistance and excellent workability.

The preparation of a metal porous body in accordance with this invention is characterized by the preparation of a slurry, in which an Fe oxide powder is used. At this time, an Fe oxide powder of fine particle size is desirable, and an average particle size of not more than 5 $\mu$m is preferred. If the particles are large, then time is needed to reduce the interior of the particles and it is difficult to form a skeleton which has a uniform composition.

As shown in FIG. 2, pores are present within the skeleton, and if the skeleton has a porous structure having a large pore area percentage, the strength is reduced. With this invention, the pore area percentage of the skeleton cross section can be suppressed to not more than 30% by using fine Fe oxide powder as indicated above.

This is because a fine-grained metal skeleton structure is formed because of the uniformity of the reduction and so on resulting from the use of fine Fe oxide powder and the formation of a uniform dispersion of the carbonized component of the resin around the Fe oxide and the Cr component etc.

The Fe oxide used in the present invention is, as mentioned above, a powder which is preferably of average particle size not more than 5 μm, but most desirably it has an average particle size of not more than 1 μm. In such a case the slurry is smooth and can be applied finely and uniformly onto the resin porous body. Moreover, the formation of a complex oxide of Fe and Cr in the first heat-treatment step is facilitated and the reactivity on reduction and sintering is enhanced and the heat-treatment time can be shortened. Furthermore, due to the use of fine-grained Fe oxide, the frequency in contact of the Fe oxide and the resin carbide is enhanced and the resin carbide is consumed uniformly. Therefore, deterioration of the sintering furnace, which is liable to occur due to the adherence of carbonaceous substances to the furnace walls when metal powders are sintered in a reducing environment, is also suppressed.

As the source material of Cr which is an alloying component, metallic Cr, Cr alloy or Cr oxide is used preferably in such an amount as to give a Cr content of not more than 30 wt % and more desirably in such an amount as to give a ratio of the Fe and Cr, i.e., Fe/Cr, within the range from 1.5 to 20, after being alloyed. The strength as a metal porous body will be reduced if Cr content is above said level. The finer the particle size of the Cr source material is, the more uniform skeleton can be obtained. However, where the Cr metal powder, etc. becomes finer, the cost rises. Therefore, the particle size of the Cr source material used must be chosen, taking into account the cost of the material powder. Practically, a particle size of not more than 40 μm is preferred. More desirably, it is not greater than 10 μm because such a particle size is suited for alloying with the Fe oxide. If it is more than 40 μm, this invites precipitation of the material powder when the powder is present in a slurry or non-uniform coating during applying the slurry onto a porous resin body, for example, and this leads to non-uniformity of the alloy composition. $Cr_2O_3$ and FeCr alloys are especially desirable as the source material for the Cr component.

If at least one of Ni, Cu Mo, Al, P, B, Si and Ti in the form of a metal powder or an oxide powder is used as the third component, then the heat resistance, corrosion resistance and mechanical strength of the metal porous body can be improved and it is therefore preferred to use such a third component. The amount of the third component in which most desirable effects are demonstrated differs for each element, while it is meaningless to use too large amount as this imparts an adverse effect on the metal skeleton.

The content of the foregoing third component in the product composition is preferably not more than 25 wt % calculated as element.

A point for consideration in connection with the mixing ratio in the slurry is the proportions of the oxygen content of Fe and Cr oxides and of oxide as the aforementioned third component and the thermosetting resin. The role of the thermosetting resin is to function as a binder which binds the slurry to the resin core which has a foam structure, and to provide a carbon source for the formation of metal carbides. The thermosetting resin is carbonized when heated after being applied, and this carbonization provides the carbon source for formation of metal carbides. Therefore, an amount of the thermosetting resin added to the slurry is related to the ratio of the amount of oxygen atoms present as the metal oxides in the slurry mixture and the amount of carbon atoms in the thermosetting resin. Most of the carbon in the resin constituting the porous resin core and the other resin component, excluding the above thermosetting rein, are burned off before or during firing and so their contribution to the carbon residue in the resultant metal porous body is very slight.

In consideration of these points, it is preferable that the mixing ratio of the resin component and the metal oxide component for preparing the slurry be determined depending on the rate of carbonization of all the resin component, including the resin porous body which forms the skeleton. The method of such determination involves, first of all, determining the weight of metal per unit area in accordance with how the porous body is used. Then an amount of the resin component is derived from the amount of metal. At the same time, the amount of carbon residue originating from the added thermosetting resin component is derived from the rate of carbon residue of the resin component. The metal alloy is then designed on the basis of the properties such as the heat resistance and mechanical strength etc. of the respective metals, and the respective amounts of Fe, Cr and the third metal etc. to be added are calculated. The amount of oxides of these metals is found from the composition of the raw material, and the amount of oxygen to be treated is obtained. The type and amount of the thermosetting resin used in the slurry are preferably adjusted on the basis of the following equation below, depending on the firing process thereof.

$$11 < X \times Y < 38 \quad (1)$$

where "X" is the rate (wt %) of the amount of the carbon residue of all the resin component composed of the porous resin core and the thermosetting resin, etc. used in the slurry, as has been specified hereinbefore. Furthermore, "Y" is the ratio by weight of all the resin component to the oxides in which the weight of the oxides corresponds to the weight of Fe oxide and Cr oxide if so selected. In those cases where the third metal oxide is used, the amount of the oxide is also counted in addition to the amounts of the oxides of Fe and Cr. If metal powder is used as the third component, the amount thereof is not counted. Furthermore, the resin component means all the resins including the skeleton resin, the thermosetting resin, etc.

If the value obtained by multiplying the rate "a" of the carbon residue of the thermosetting resin by the ratio "b" by weight of the thermosetting resin component to the oxide(s) is within the range of greater than 5.1 and smaller than 11, as shown in the equation (2) above, then the amount of carbon ultimately remaining in the skeleton of the final metal porous body can be adjusted within the range between 0.1% and 3.5%.

Furthermore, if the amount of thermosetting resin is determined to satisfy the equations (1) or (2) above, only a trace of carbon will remain in the metal porous body, which therefore will manifest excellent mechanical strength, heat resistance and corrosion resistance. The metal structure in the skeleton also becomes fine and the area of pores present in the skeleton cross section, naturally, also becomes 30% or lower.

The slurry prepared in the way described above is applied onto a resin porous body. As a method of application, it is desirable to apply the slurry onto the resin porous body by spraying, dipping or other appropriate method, and then squeezing the coated porous body by rolls or the like so that a desired amount of slurry is applied. It is important to apply the slurry uniformly to the resin porous body including the inside of the resin skeleton. The thermosetting resin to be used for application should be liquid or made into a solution by a solvent, which is water if the resin is water soluble and is an organic solvent if the resin is water-insoluble. The resin is diluted with such solvent to adjust the viscosity so that a prescribed amount of slurry can be applied onto the resin skeleton. After application has been completed, the slurry is dried. The drying treatment must be carried out at a temperature lower than the temperature at which the skeleton resin deforms, while the atmosphere and ventilation can be appropriately selected as appropriate.

The resin core on which the slurry has been applied and dried is fired in a non-oxidizing atmosphere whereby, as mentioned above, a metal porous body having a structure in which a carbide is uniformly dispersed throughout the skeleton mainly composed of Fe and Cr is formed. The firing process is preferably carried out by changing the conditions in the two heat-treatment steps as below. Specifically, under the conditions of the first heat-treatment step the resin core is removed and, at the same time, the thermosetting resin is carbonized. Further, the metal oxide is reduced with carbons resulting from carbonization while a part of the metal component is converted into carbides. Subsequently, the conditions are changed to raise the temperature under which a high-strength porous metal structure is formed by sintering. Under these conditions, it is possible to obtain the metal porous body in which the metal carbides are formed and uniformly distributed throughout the skeleton thereof.

In the above-mentioned firing process, the temperature in the first heat-treatment conditions is preferably lower than the condition for forming a uniform metal composition, and an atmosphere at about 800° C. is preferred. Preferably, the firing is performed in the range of from 750° C. to 1100° C. Conditions for the second heat-treatment step for sintering depend on the metal composition. In this case, since an ally of Fe and Cr is formed and sintered, a temperature of about 1200° C. is preferred, and practically, operation should be carried out within the range of from 1100° C. to 1350° C.

Alternatively, it is also possible to carry out the above-mentioned firing in the two heat-treatment steps as below. Specifically, in the first heat-treatment step, a complex oxide of Fe and Cr is formed by the reaction of an Fe oxide with Cr metal, Cr alloy or Cr oxide at the same time as the resin component is carbonized. The reduction and sintering operation in the next heat-treatment step is facilitated by the formation of this FeCr complex oxide. A non-oxidizing atmosphere is used in the first heat-treatment step. A temperature of at least 400° C. but not more than 900° C. is preferred since the resin component must be carbonized. If the temperature. is below 400° C., the carbonization of the resin component takes time and this is uneconomical. Moreover, if the carbonization does not proceed satisfactorily, then problems such as formation of tar or the like will arise in the next process. If the temperature exceeds 900° C., then a reduction reaction will proceed, exceeding formation of the complex oxide, and it will be difficult to obtain a fine-grained metal structure in the second heat-treatment step.

In this method, carbonization of the resin does not occur if the reduction and sintering step is carried out without the first heat-treatment step mentioned above and the skeleton structure cannot be retained, wherefore cracking and breakage of the skeleton, for example, are liable to occur. Moreover, the alloying and sintering will become uneven since the sintering is carried out without forming the aforementioned FeCr complex oxide.

In the second heat-treatment step, an oxidation-reduction reaction by reaction of the FeCr complex oxide with carbon formed from the resin component during the earlier step and sintering between the metals constituting the metal skeleton are achieved simultaneously. A reducing atmosphere is preferred, and typical examples include hydrogen gas, ammonia degradation gas or gaseous mixtures of hydrogen and nitrogen. The sintering can also be carried out in a vacuum. The atmosphere temperature is preferably at least 950° C. and not more than 1350° C., and under such conditions the FeCr complex oxide is reduced by the carbon and an FeCr alloy is formed at the same time as the skeleton is being formed. If the temperature in the atmosphere is less than 950° C., then more time is required for reduction and sintering, and this is uneconomical. If the temperature exceeds 1350° C., then a liquid phase is formed during sintering and it is impossible to retain the metal skeleton. A temperature range between 1100° C. and 1250° C. is more preferred.

When forming the aforementioned complex oxide of Fe and Cr, longer time and higher temperature are needed when reduction reaction is conducted only in a reducing gas such as hydrogen. However, in the presence of carbon as the carbides which have been formed from the resin component in the first heat-treatment step, the reduction reaction can be promoted under the aforementioned conditions. The skeleton of the final metal porous-body also has a superior fine-grained structure and so the mechanical strength is improved. Furthermore, the final metal skeleton is also ultimately formed with a uniform FeCr alloy since an FeCr complex oxide has been reduced.

A concrete description of the present invention is given below by means of examples.

EXAMPLE 1

A slurry was prepared by mixing 50 wt % of $Fe_2O_3$ powder with an average particle size of 0.7 $\mu$m, 23 wt % of FeCr (60% Cr) alloy powder with an average particle size of 4 $\mu$m, 17 wt % of a 65% phenol resin solution as a thermosetting resin, 2 wt % of CMC as a dispersing agent and 8 wt % of water. This slurry was impregnated into a 10 mm thick polyurethane foam having 1.8 cells per inch, and the slurry excessively deposited was removed with metal rolls. The sheet was dried for 10 minutes at 120° C., and then treated under the heat-treatment conditions shown in Table 1 to obtain the respective metal porous bodies. The physical properties, mechanical strength and heat resistance of the ultimately obtained metal porous bodies were examined and the results are shown in Table 2.

TABLE 1

| No. | First Heat-Treatment Step | Second Heat-Treatment Step |
|---|---|---|
| 1* | 700° C., 15 minutes, in $N_2$ | 900° C., 30 minutes, in $H_2$ |
| 2 | 700° C., 15 minutes, in $N_2$ | 1150° C., 30 minutes, in $H_2$ |
| 3 | 700° C., 15 minutes, in $N_2$ | 1250° C., 30 minutes, in $H_2$ |
| 4 | No treatment | 1250° C., 30 Minutes, in $H_2$ |
| 5 | 850° C., 20 minutes, in Ar | 1150° C., 30 minutes, in vacuum |
| 6 | 850° C., 20 minutes, in Ar | 1200° C., 30 minutes, in vacuum |

TABLE 1-continued

| No. | First Heat-Treatment Step | Second Heat-Treatment Step |
|---|---|---|
| 7* | 850° C., 20 minutes, in Ar | 1400° C., 30 minutes, in vacuum |

*comparative samples

As to No. 1, the temperature was too low in the second heat-treatment step, and as to No. 7 the temperature of the second heat-treatment step was too high. Therefore, these metal porous bodies were inferior to the other metal porous bodies in the above mentioned properties.

TABLE 2

| No. | Density (g/cc) | Average Porosity*1 of the Skeleton Part (%) | Tensile Strength (kg/mm$^2$) | Oxidation Increment Rate*2)(%) |
|---|---|---|---|---|
| 1 | 0.51 | 53 | 0.2 | 10.5 |
| 2 | 0.51 | 7 | 1.5 | 1.6 |
| 3 | 0.51 | 6 | 1.6 | 1.3 |
| 4 | 0.51 | 6 | 0.3 | 1.5 |
| 5 | 0.51 | 5 | 1.6 | 1.4 |
| 6 | 0.51 | 5 | 1.7 | 1.2 |
| 7* | 1.83 | 3 | 0.2 | 1.2 |

*The metal skeleton of No. 7 melted during sintering and the porous structure was not retained.
*1Proportion of pores with respect to the skeleton cross sectional area in the cross section of the metal skeleton (hereinafter, the same definition is applied).
*2)rate(%) of increase in weight due to oxidation when maintained at 900° C. for 50 hours in air.

According to the results indicated above, the average porosity of the skeleton part increases and the mechanical strength falls when the temperature of the second heat-treatment step is too low. The surface area is also increased and so the heat resistance falls due to oxidation. Conversely, if the temperature is too high, then the entire metal skeleton is not retained and the density increases, but the mechanical strength falls and so the usefulness as a metal porous body deteriorates. The density of the entire porous body depends on the amount of slurry coated. From the above, the preferred second heat-treatment temperature is from 950 to 1350° C. and the heat-treatment is preferably carried out with a two-stage process.

EXAMPLE 2

Slurries were prepared by mixing 50 wt % of an $Fe_2O_3$ powder with the average particle size shown in Table 3, 23 wt % of FeCr (60% Cr) alloy powder with an average particle size of 8 $\mu$m, 17 wt % of a 65% phenol resin solution as a thermosetting resin, 2 wt % of CMC as a dispersing agent and 8 wt % of water. The slurry was impregnated into a 10 mm thick polyurethane foam having 32 cells per inch and excessive slurry was removed with metal rolls. The slurry was then dried for 10 minutes at 120° C. The polyurethane and phenol resin were carbonized in a first heat-treatment step at 800° C. in $N_2$ for 20 minutes and reduction and sintering were carried out at 1200° C. in $H_2$ for 30 minutes to obtain FeCr alloy metal porous bodies. The physical properties, mechanical strength and heat resistance of the metal porous bodies thus obtained were examined and the results are shown in Table 4.

TABLE 3

| No. | Average Particle Size ($\mu$m) |
|---|---|
| 11 | 8.9 |
| 12 | 2.1 |
| 13 | 0.8 |
| 14 | 0.5 |

TABLE 4

| No. | Density (g/cc) | Average Porosity of the Skeleton (%) | Tensile Strength (kg/mm$^2$) | Oxidation Increment Rate*(%) |
|---|---|---|---|---|
| 11 | 0.45 | 38 | 0.3 | 7.5 |
| 12 | 0.45 | 21 | 0.8 | 4.1 |
| 13 | 0.45 | 6 | 1.2 | 1.5 |
| 14 | 0.45 | 4 | 1.3 | 1.5 |

*rate(%) of increase in weight due to oxidation when maintained at 900° C. for 50 hours in air.

As seen from Tables 3 and 4, if the average particle size of the Fe oxide is large, then the average porosity of the skeleton part exceeds 30% and the mechanical strength falls. The surface area of the skeleton of the resultant metal porous body also increases as the average particle size of the Fe oxide increases and the strength and the degree of sintering of the metal porous body lower. As a result, the weight increase due to oxidation becomes greater. Hence, the average particle size of the Fe oxide is preferably not more than 5 $\mu$m, and most desirably not more than 1 $\mu$m.

EXAMPLE 3

Metal porous bodies were prepared by the same production process as described in Example 2, except that the rate of carbon residue was varied by changing the amount of the phenol resin solution used as a thermosetting resin and an $Fe_2O_3$ powder with an average particle size 0.7 $\mu$m was used. The conditions were represented by the rate of carbon residue "X" of the resin component, determined by the procedures previously specified, and the ratio "Y"by weight of the resin component with respect to the oxide in Table 5. The resin component was composed of the phenol resin, urethane foam and CMC.

TABLE 5

| No. | X (wt %)* | Y* | X × Y* |
|---|---|---|---|
| 15 | 52 | 0.12 | 6.24 |
| 16 | 52 | 0.31 | 16.12 |
| 17 | 52 | 0.45 | 23.4 |
| 18 | 52 | 0.56 | 29.12 |
| 19 | 52 | 0.67 | 34.84 |
| 20 | 52 | 0.76 | 39.52 |

*When calculation of "X" and "Y", the amount of the resin component was measured after applying the slurry, excluding the metal component ($Fe_2O_3$ and FeCr alloy powders), onto the urethane foam and drying the foam.

As seen from Table 5, the,rate of carbon residue of the resin component is not greatly affected by changes in the amount of the used resin component because it depends on the physical properties of the resin component, but the value of X×Y is changed by the proportion of the amount of the resin component with respect to the amount of the oxide. The results obtained on investigating the properties, mechanical strength and heat resistance of the metal porous bodies formed under these conditions are shown in Table 6.

TABLE 6

| No. | Density (g/cc) | Average Porosity of the Skeleton Part (%) | Tensile Strength (kg/mm$^2$) | Oxidation Increment Rate*(%) |
|---|---|---|---|---|
| 15 | 0.51 | 28 | 0.6 | 5.5 |
| 16 | 0.51 | 16 | 0.9 | 2.1 |
| 17 | 0.51 | 5 | 1.5 | 1.5 |
| 18 | 0.51 | 6 | 1.4 | 1.5 |
| 19 | 0.51 | 11 | 0.9 | 2.2 |
| 20 | 0.51 | 16 | 0.5 | 3.7 |

*rate(%) of increase in weight due to oxidation when maintained at 900° C. for 50 hours in air.

According to Table 6, differences arise in the properties of the obtained metal porous bodies depending on the value of X×Y. Analyzing the results shown Table 6 in connection with the values shown in Table 5, the properties of the final metal porous body deteriorate if the value of X×Y is small (i.e., if the amount of the resin component relative to the amount of the oxide is small). Especially, the porosity of the skeleton cross section increases and, as a result, the mechanical strength falls and the weight increase due to oxidation tends to increase. Conversely, the same trends also arise if the value of X×Y is too large (i.e., if the amount of the resin component with respect to that of the oxide is large). Hence, in the samples of this invention, preferred metal porous bodies were obtained under conditions where the value of X×Y was more than 11 but less than 38.

EXAMPLE 4

Each slurry was prepared by mixing 50 wt % of an $Fe_2O_3$ powder with an average particle size of 0.8 μm, 7.9 wt % of a Cr powder with an average particle size of 5 μm, the third metal powder shown in table 7, and 12 wt % of a 65% phenol resin solution, 2 wt % of CMC and 8 wt % of water. The slurry was impregnated into and applied onto a 15 mm thick polyurethane foam having 21 cells per inch, and excessive slurry was removed with metal rolls. The applied slurry was then dried for 10 minutes at 120° C. and heat treated. Firstly, carbonization of the resin and the formation of FeCr complex oxide were carried out for 25 minutes at 700° C. in an $N_2$ atmosphere and then reduction and sintering were carried out for 30 minutes at 1180° C. in a vacuum and FeCr alloy metal porous bodies which contained the given third metal component were obtained. Physical properties, mechanical strength and heat resistance of the resultant metal porous bodies were examined and the results are as shown in Table 8.

TABLE 7

| No. | Third metal powder | Amount mixed (wt %) |
|---|---|---|
| 21 | Ni | 3.5 |
| 22 | Mo | 0.5 |
| 23 | Si | 0.3 |
| 24 | Ni | 4.4 |
| | Cu | 0.8 |

TABLE 8

| No. | Density (g/cc) | Average Porosity of the Skeleton Part (%) | Tensile Strength (kg/mm$^2$) | Oxidation Increment Rate*(%) |
|---|---|---|---|---|
| 21 | 0.55 | 5 | 1.4 | 2.5 |
| 22 | 0.55 | 6 | 1.3 | 2.9 |
| 23 | 0.55 | 5 | 1.3 | 3.2 |
| 24 | 0.55 | 7 | 1.4 | 2.1 |

*rate(%) of increase in weight due to oxidation when maintained at 900° C. for 50 hours in air.

According to the results shown in Tables 7 and 8, it is possible to make improvements by including the third metal in the FeCr alloy metal porous bodies and, provided that the amount is not so large as to influence the composition, inclusion of the third metal does not have an adverse effect in the physical properties, mechanical strength and heat resistance, and the properties such as heat resistance and mechanical strength can be improved by increasing the third component.

EXAMPLE 5

Slurries were prepared by varying the amounts of the resin component and the metal oxide in the slurry of No. 21 used in Example 4 above. $Fe_2O_3$ was the subject metal oxide and the resin component was composed of the phenol resin, polyurethane foam and CMC. In particular the amount of phenol resin in the resin component was changed. The remainder was unchanged from the slurry of No. 21. The mixing ratios are shown by X and Y in Table 9.

TABLE 9

| No. | X* (wt %) | Y* | X × Y* |
|---|---|---|---|
| 25 | 55 | 0.18 | 9.9 |
| 26 | 55 | 0.35 | 19.25 |
| 27 | 55 | 0.45 | 24.75 |
| 28 | 55 | 0.58 | 31.9 |
| 29 | 55 | 0.67 | 36.85 |
| 30 | 55 | 0.79 | 43.85 |

*When calculation of "X" and "Y", the amount of the resin component was measured after applying the slurry, excluding the metal component ($Fe_2O_3$ and Cr powders), onto the urethane foam and drying the foam.

Metal porous bodies were made under the same production conditions as in Example 4, using these slurries. The properties, mechanical strength and heat resistance of the final metal porous bodies were examined. The results are shown in Table 10.

TABLE 10

| No. | Density (g/cc) | Average Porosity of the Skeleton Part (%) | Tensile Strength (kg/mm$^2$) | Oxidation Increment Rate*(%) |
|---|---|---|---|---|
| 25 | 0.51 | 25 | 0.7 | 5.9 |
| 26 | 0.51 | 6 | 1.4 | 2.8 |
| 27 | 0.51 | 5 | 1.5 | 2.5 |
| 28 | 0.51 | 6 | 1.2 | 2.6 |
| 29 | 0.51 | 10 | 0.8 | 3.9 |
| 30 | 0.51 | 15 | 0.5 | 6.7 |

*rate(%) of increase in weight due to oxidation when maintained at 900° C. for 50 hours in air.

As can be seen the results in Tables 9 and 10, excellent metal porous bodies can be formed if mixing ratios are so adjusted that the value of X×Y is within the range exceeding 11 and less than 38.

EXAMPLES 6 to 10

A slurry was prepared by mixing 52 parts by weight of an $Fe_2O_3$ powder with an average particle size of 0.6 μm, 23 parts by weight of an FeCr alloy (Cr 63%) powder with an average particle size of 7 μm, 13 parts by weight of a 65% phenol resin solution as a thermosetting resin, 1.5 parts by weight of a dispersing agent (CMC) and 10.5 parts by weight of water.

This slurry was impregnated into a 10 mm thick polyurethane foam sheet having 13 cells per 25.4 mm (1 inch). The slurry applied in excess was removed with metal rolls as it was being drawn up and then the sheet was dried for 10 minutes at 120° C. This sheet was heat-treated under each set of conditions shown in Table 11 and a metal porous body was obtained. The details of the final metal porous body product were as shown in Table 12.

It is clear from these results that the apparent density of the metal porous body does not change with the amount of carbon residue in the metal porous body, but the workability when bending operation is reduced if the amount of the carbon residue is increased and, conversely, the hardness increases as the amount of carbon residue is increased.

The metal porous bodies of this invention must have good workability and sufficient hardness and, therefore, the amount of the carbon residue in them has to be within an appropriate range, with the particularly preferred range being from at least 0.1% to not more than 3.5%.

TABLE 11

| No. | First Heat-Treatment Conditions | Second Heat-Treatment Conditions |
|---|---|---|
| Example 6 | 800° C., 5 minutes, in $N_2$ | 1200° C., 10 minutes, in $H_2$ |
| Example 7 | 800° C., 5 minutes, in $N_2$ | 1200° C., 30 minutes, in $H_2$ |
| Example 8 | 800° C., 5 minutes, in $N_2$ | 1200° C., 60 minutes, in $H_2$ |
| Example 9 | 1100° C., 10 minutes, in $N_2$ | 1200° C., 30 minutes, under Vacuum |
| Example 10 | 1100° C., 10 minutes, in $H_2$ | 1200° C., 30 minutes, under Vacuum |

TABLE 12

| No. | Density (g/ml) | Amount of Carbon Residue (%) | Minimum Radius of Curvature* (cm) | Vickers Hardness (Hv) |
|---|---|---|---|---|
| Example 6 | 0.82 | 0.9 | 4.5 | 207 |
| Example 7 | 0.82 | 0.7 | 2.8 | 192 |
| Example 8 | 0.82 | 0.3 | 2.1 | 180 |
| Example 9 | 0.82 | 2.5 | 12.6 | 296 |
| Example 10 | 0.82 | 1.6 | 9.7 | 221 |

*Minimum radius of curvature when breaking occurred on bending.

EXAMPLES 11 to 15

Slurries were prepared with the compositions shown in Table 13 by changing the proportion of the thermosetting resin in the slurry compositions used in Example 6 so that the ratios of the thermosetting resin to the a metal oxide were as shown in Table 13. Using the resultant slurries, metal porous bodies were produced under the same conditions as in Example 6. Every slurry was able to form a metal porous body and the properties thereof were as shown in Table 14.

As clear from the results shown in Table 14, the properties deteriorate when bending if the amount of carbon residue in the metal porous body is too low and therefore the amount of a metal carbide phase is small. An increase in the carbon residue facilitates bending operation temporarily. However, when the amount of carbon residue is further increased, the hardness increases and the workability tends to become worse. Hence, the preferred amount of carbon residue is at least 0.1% and not more than 3.5%.

TABLE 13

| No. | Added Amount of Thermosetting Resin (parts by weight) | Rate of Carbon Residue of Resin a(%)* | Ratio by weight of Resin to Oxide b(–)* | a × b* |
|---|---|---|---|---|
| Example 11 | 6 | 42 | 0.115 | 4.8 |
| Example 12 | 8 | 42 | 0.154 | 6.5 |
| Example 13 | 10 | 42 | 0.192 | 8.1 |
| Example 14 | 16 | 42 | 0.307 | 12.8 |
| Example 15 | 18 | 42 | 0.346 | 14.5 |

*"a" and "b" were calculated using the weight of the thermosetting resin in the state of 65% solution.

TABLE 14

| No. | Density (g/ml) | Amount of Carbon Residue (%) | Minimum Radius of Curvature* (cm) | Vickers Hardness (Hv) |
|---|---|---|---|---|
| Example 11 | 0.82 | 0.002 | 6.2 | 131 |
| Example 12 | 0.82 | 0.13 | 1.8 | 153 |
| Example 13 | 0.82 | 0.35 | 2.5 | 191 |
| Example 14 | 0.82 | 3.8 | 15.6 | 325 |
| Example 15 | 0.82 | 4.3 | 25.1 | 575 |

*Minimum radius of curvature when breaking occurred on bending.

EXAMPLES 16 to 20

Slurries were prepared using 54 parts by weight of an $Fe_2O_3$ powder with an average particle size of 0.5 μm, 16 parts by weight of an FeCr alloy (Cr 63%) powder with an average particle size of 5 μm, 1.5 parts by weight of a dispersing agent (CMC) and the amounts of a 65% phenol resin solution shown in Table 15 as a thermosetting resin.

The slurries were impregnated into a 12 mm thick polyurethane foam sheet having 26 cells per 25.4 mm (1 inch) and then excessive slurry was removed with metal rolls. The sheets were dried for 10 minutes at 120° C. The sheets were then heat treated under the conditions shown for Example 9 in Table 11 to make metal porous bodies. The properties of the metal porous bodies obtained are shown in Table 16.

The difference in density when compared with the earlier data of Examples 6 to 15 is due to the difference in the porosity etc. of the urethane foam sheet used as the base material. The relationships of the minimum radius of curvature (which indicates workability) with the amount of carbon residue in the metal porous body and the hardness with amount of the carbon residue were similar to the results shown in Table 14. The workability becomes worse if the amount of carbon residue exceeds 3.5%. However, metal porous bodies having such a relatively high carbon residue content are useful in fields where wear resistance is regarded as being important but a high degree of workability is not required. Furthermore, in cases such as Example 16 where the amount of carbon residue in the metal porous bodies is small, the hardness is low and so it is possible that good results will not be achieved in the preparation of a metallic composite material using such a metal porous body.

TABLE 15

| No. | Added Amount of Thermosetting Resin (parts by weight) | Rate of Carbon Residue of Resin a* (%) | Ratio by weight of Resin to Oxide b* (–) | a × b* |
|---|---|---|---|---|
| Example 16 | 8 | 38 | 0.148 | 5.6 |
| Example 17 | 10 | 38 | 0.185 | 7.0 |
| Example 18 | 12 | 38 | 0.222 | 8.4 |
| Example 19 | 14 | 38 | 0.259 | 9.8 |
| Example 20 | 16 | 38 | 0.296 | 11.2 |

*"a" and "b" were calculated using the weight of the thermosetting resin in the state of 65% solution.

TABLE 16

| No. | Density (g/ml) | Amount of Carbon Residue (%) | Minimum Radius of Curvature* (cm) | Vickers Hardness (Hv) |
|---|---|---|---|---|
| Example 16 | 0.71 | 0.12 | 1.9 | 148 |
| Example 17 | 0.71 | 0.31 | 1.3 | 162 |
| Example 18 | 0.71 | 1.9 | 4.9 | 213 |
| Example 19 | 0.71 | 2.4 | 8.5 | 256 |
| Example 20 | 0.71 | 3.7 | 14.8 | 308 |

*Minimum radius of curvature when breaking occurred on bending.

Preparation Example 1 of Metallic Composite Material

A part of each of the metal porous bodies obtained in the aforementioned Examples 6 to 20 was introduced into a mold, an aluminum alloy (AC8C) melt heated at 750° C. was poured in under a pressure of 39.2 MPa and an aluminum composite material was prepared. Each of aluminum composite materials obtained was cut into a rectangular sample and subjected to roller pin wear tests.

The roller pin test conditions were as indicated below.

Opposing Material: Rotating nitride steel roller with a diameter of 80 mm and a width of 10 mm Rate of Rotation: 200 rpm Pressing Load: 60 kg Time: 20 Minutes Lubricating Oil: SAE10W30

Dripping Rate: 5 ml/min

Heat was generated when the aluminum composite material prepared using each of the metal porous bodies which had been prepared in Examples 6 to 20 was pressed under a pressing load which was applied from above by the opposing material rotating in the perpendicular direction, and so the lubricating oil was applied dropwise so as to prevent fusion of the roller and the composite material sample. The rotation of the opposing material was stopped after 20 minutes had elapsed after loading and the wear depth of the sample was measured. The results obtained are shown in Table 17. Moreover, the aluminum alloy (AC8C) was cut into a rectangular form and used as Comparative Example 1.

In the roller pin wear test, although the compatibility with the opposing material also has an effect on the test results, it is confirmed as a result that significant wear resistance can be obtained as an effect derived from compositing. However, in those cases where the amount of carbon residue in the metal porous body is very small, the effect of compositing is reduced. The wear resistance improves as the amount of carbon residue increases. In this test, the metal porous bodies of the invention were not worked. However, where complicated working is needed, the workability should be taken into account. Accordingly, the amount of carbon residue must be appropriately adjusted and selected on the basis of which of the wear resistance and workability is to be emphasized where the amount of carbon residue is in a large content range.

TABLE 17

| Metal Porous Body Used | Wear Depth (μm) |
|---|---|
| Example 6 | 18 |
| Example 7 | 21 |
| Example 8 | 25 |
| Example 9 | 13 |
| Example 10 | 15 |
| Example 11 | 43 |
| Example 12 | 29 |
| Example 13 | 20 |
| Example 14 | 14 |
| Example 15 | 12 |
| Example 16 | 39 |
| Example 17 | 20 |
| Example 18 | 16 |
| Example 19 | 14 |
| Example 20 | 11 |
| Comparative Example 1 | 67 |

Preparation Example 2 of Metallic Composite Material

A metallic composite material was prepared using a magnesium alloy and each of the metal porous bodies obtained in Examples 6 to 20 in the same way as in Preparation Example 1 of Metallic Composite Material. Part of the metal porous body of each example was introduced into a mold and a melt of magnesium alloy (AZ91A) heated at 750° C. was poured in under a pressure of 24.5 MPa to form a magnesium composite material. The composite material obtained was cut into a rectangular form and the wear resistance was measured using a roller pin wear-testing machine.

The roller pin wear test conditions were as indicated below.

Opposing Material: Rotating nitride steel roller with a diameter of 80 mm and a width of 10 mm Rate of Rotation: 300 rpm Pressing Load: 50 kg Time: 15 Minutes Lubricating Oil: SAE10W30

Dripping Rate: 5 ml/min

The wear test was carried out in the same manner as described in Preparation Example 1 and the results are shown in Table 18. In this test, a magnesium alloy (AZ91A) which had been cut into a rectangular form was used for Comparative Example 2. As shown in Table 18, when the amount of carbon residue in the metal porous body was small, the wear depth approached that of the non-composite test sample of Comparative Example 2. However, the wear resistance improved when carbon residue (including the metal carbides) was present.

The interrelationship between the amount of residual carbide and the degree of wear was such that, as with the aluminum composite materials, there was a tendency for the hardness to increase and the wear resistance to improve as the amount of carbon residue increased.

TABLE 18

| Metal Porous Body Used | Wear Depth (μm) |
|---|---|
| Example 6 | 50 |
| Example 7 | 55 |
| Example 8 | 61 |
| Example 9 | 40 |
| Example 10 | 45 |
| Example 11 | 97 |
| Example 12 | 69 |
| Example 13 | 54 |
| Example 14 | 42 |
| Example 15 | 37 |
| Example 16 | 86 |
| Example 17 | 52 |
| Example 18 | 46 |
| Example 19 | 41 |
| Example 20 | 35 |
| Comparative Example 2 | 143 |

The distinguishing feature of the metal porous bodies of this invention is the presence of Fe carbide and/or FeCr carbide in an alloy of Fe and Cr as a uniformly dispersed phase, which improves the hardness of the skeleton itself and, as a result, has a beneficial effect in the above-mentioned wear tests.

EXAMPLES 21 to 25

Slurries were prepared by mixing 50 parts by weight of $Fe_2O_3$ powder with an average particle size of 0.4 μm, 14.5 parts by weight of an FeCr (Cr 63%) alloy powder with an average particle size of 5 μm the metal powder in the amounts shown in Table 19, 1.5 parts by weight of a dispersing agent (CMC), 11 parts by weight of water and 12 parts by weight of a 65% phenol resin solution. Each of the slurries was impregnated into a 10 mm thick polyurethane foam having 32 cells per inch and then the slurry adhered in excess was removed with metal rolls. The sheet was dried for 10 minutes at 120° C., and then treated under the heat-treatment conditions shown in Example 9 in Table 11 to obtain a metal porous body. The density, carbon residue content and Vickers's hardness of the final metal porous body are shown in Table 20.

TABLE 19

| No. | Metal Powder | Added Amount (parts by weight) |
|---|---|---|
| Example 21 | Ni (average particle size 2.8 μm) | 4.4 |
| Example 22 | Ni (average particle size 2.8 μm) | 6.6 |
| | Mo (average particle size 6.9 μm) | 1.1 |
| Example 23 | Cu (average particle size 1.8 μm) | 1.5 |
| Example 24 | Si (average particle size 9.1 μm) | 0.8 |
| Example 25 | Al (average particle size 8.7 μm) | 1.3 |

TABLE 20

| No. | Density (g/ml) | Amount of Carbon Residue (%) | Minimum Radius of Curvature* (cm) | Vickers Hardness (Hv) |
|---|---|---|---|---|
| Example 21 | 1.1 | 0.73 | 0.9 | 193 |
| Example 22 | 1.1 | 0.72 | 0.7 | 203 |
| Example 23 | 1.1 | 0.70 | 2.3 | 213 |
| Example 24 | 1.1 | 0.76 | 3.5 | 226 |
| Example 25 | 1.1 | 0.75 | 4.2 | 232 |

*Minimum radius of curvature when breaking occurred on bending.

Preparation Example 3 of Metallic Composite Material

The above-mentioned metal porous bodies prepared in Examples 21 to 25 were each set in a metal mold and aluminum composite materials were made by pouring in a melt of aluminum alloy (AC8A) heated at 760° C. under a pressure of 20 kg/cm$^2$. The results on subjecting the composite materials obtained to roller pin wear tests are shown in Table 21. Moreover, the wear test conditions were as indicated below.

Opposing Material: Rotating nitride steel roller with a diameter of 80 mm and a width of 10 mm Rate of Rotation: 50 rpm Pressing Load: 100 kg Time: 20 minutes Lubricating oil: SAE10W30

Dripping Rate: 1 cc/min

TABLE 21

| Metal Porous Body Used | Wear Depth (μm) |
|---|---|
| Example 21 | 32 |
| Example 22 | 30 |
| Example 23 | 27 |
| Example 24 | 25 |
| Example 25 | 19 |
| Comparative Example 3 | 105 |

Comparative Example 3: Al Alloy (AC8A)

As described above, FeCr alloy metal porous bodies in which metal carbides are uniformly dispersed and in which it is possible to achieve excellent properties in terms of strength and heat resistance can be obtained by means of the preparation method of the present invention. Moreover, it is possible to obtain metal porous bodies in which a third metal, which further improves the properties of the metal porous body, is alloyed.

Furthermore, the metal porous bodies of this invention are suitable as skeletons when obtaining Al composite alloy materials or Mg composite materials since they have a metal carbide phase dispersed uniformly in the skeleton and suitable workability and hardness are maintained. The wear resistance, in particular, of the composite materials obtained using the metal porous bodies of this invention is improved, and they also have appropriate workability.

What is claimed is:

1. A metal porous body having a skeleton which has a foam structure, is composed of an alloy composed mainly of Fe and Cr and includes a Cr cabide and/or FeCr carbide uniformly dispersed therein, wherein the metal porous body has a density of 0.45 to 1.1 g/cm$^3$.

2. The metal porous body according to claim 1, wherein the carbon content in said porous body is at least 0.1% and not more than 3.5%.

3. The metal porous body according to claim 1, wherein at least one element selected from the group consisting of Ni, Cu, Mo, Al, P, B, Si and Ti is included in said porous body.

4. A method for the preparation of a metal porous body comprising:

preparing a slurry comprising, as the main components, an Fe oxide powder having an average particle size of not more than 5 $\mu$m, at least one powder selected from group consisting of powders of metallic Cr, Cr alloy and Cr oxide, a resin component comprising a thermosetting resin, and a diluent;

applying the slurry onto a resin core body with a foam structure and drying the same; and firing in a non-oxidizing atmosphere, including a heat-treatment at a temperature of 950 to 1350° C. to thereby obtain a sintered body having a skeleton which has a foam structure, is composed of an alloy composed mainly of Fe and Cr and includes Cr carbide and/or FeCr carbide uniformly dispersed therein.

5. The method for the preparation of a metal porous body according to claim 4, wherein said firing is carried by two heat-treatment steps consisting of a first heat-treatment in which the resin core is removed at the same time with the thermosetting resin being carbonized, and the metal oxide is reduced by the carbon thus produced while a part of the metal component is converted into carbide, and a second heat-treatment step in which a sintered body having a high-strength foam structure is formed by heating at a high temperature of at least 1100° C. but not more than 1350° C.

6. The method for the preparation of a metal porous body according to claim 4, wherein said firing is carried out by two-treatment steps consisting of a first heat-treatment step in which the resin component is carbonized in a non-oxidizing atmosphere, and a second heat-treatment step in which a sintered body having a high-strength body foam structure is formed by reducing the metal oxide while converting a part of the metal component into a carbide with the carbon produced in the first heat-treatment step, in a reducing atmosphere at a temperature of at least 950° C. but not more than 1350° C., and then alloying and sintering the reduced metal component.

7. The method for the preparation of a metal porous body according to claim 4, wherein at least one powder selected from the group consisting of Ni, Cu, Mo, Al, P, B, Si and Ti and oxides thereof is further mixed to said slurry.

8. The method for the preparation of a metal porous body according to claim 4, wherein, when the resin component is mixed with the oxide powder to prepare the slurry, the amount of the whole resin component composed of the resin component to be mixed in the slurry and the resin core body is determined such that the rate of the carbon residue of the whole resin component and the ratio of the whole resin component to the oxide are in a range which satisfies the equation (1) below:

$$11<X\times Y<38 \quad (1)$$

where:

X=rate of the carbon residue of the resin component (wt %) and

Y=ratio by weight of the resin component to the oxide.

9. The method for the preparation of a metal porous body according to claim 4, wherein, when the thermosetting resin is mixed with the oxide powder, the amount of the resin is determined such that the rate of the carbon residue of the thermosetting resin and the ratio by weight of the thermosetting resin to the oxide are in a range which satisfies the equation (2) below:

$$5.1<a\times b<11 \quad (2)$$

where:

a=rate of carbon residue of the thermosetting resin (wt %) and b=ratio by weight of the thermosetting resin to the oxide.

10. A composite alloy material prepared by impregnating a metal Al alloy or Mg alloy into a metal porous body under a pressure of at least 98 kPa, wherein the metal porous body has a foam structure, is composed of an alloy composed mainly of Fe and Cr and includes a Cr carbide and/or FeCr uniformly dispersed therein.

11. The metal porous body according to claim 1, wherein the skeleton has an open pore area ratio of not greater than 30%.

* * * * *